US007081150B2

(12) United States Patent
Loper, Jr. et al.

(10) Patent No.: US 7,081,150 B2
(45) Date of Patent: Jul. 25, 2006

(54) ADDITIVE FOR INOCULATION OF CAST IRON AND METHOD

(76) Inventors: Carl R. Loper, Jr., 4730 LaFayette Dr., Madison, WI (US) 53705; Simon N. Lekakh, 455 Lochmoor Pl., Eugene, OR (US) 97405

( * ) Notice: Subject to any disclaimer, the term of this patent is extended or adjusted under 35 U.S.C. 154(b) by 146 days.

(21) Appl. No.: 10/290,009

(22) Filed: Nov. 7, 2002

(65) Prior Publication Data

US 2005/0050992 A1 Mar. 10, 2005

(51) Int. Cl.
*C21B 3/02* (2006.01)
*B22D 27/00* (2006.01)

(52) U.S. Cl. ..... 75/305; 75/314; 75/316; 75/328; 148/321; 164/55.1; 164/56.1; 164/57.1; 164/58.1

(58) Field of Classification Search ..... 420/31, 420/32; 148/321; 75/305, 314, 316, 328; 164/55.1–59.1
See application file for complete search history.

(56) References Cited

U.S. PATENT DOCUMENTS 6,102,983 A 8/2000 Skaland
6,126,713 A 10/2000 Igarashi et al.
6,293,988 B1 9/2001 Naro

OTHER PUBLICATIONS

C.R. Loper, Jr., "Inoculation of Cast Iron—Summary of Current Understanding," *American Foundrymen's Society. Transactions of the AFS*, 1999, vol. 107, pp. 523-528.
"Cast Iron Technology," R. Elliott, Butterworths, London, Liquid metal Preparation, 1988, pp. 79-85,89-90.
A. Sverdlin, S. Lekakh et al., "'Chips'—Process for Cast Iron Inoculation," *Foundry Managemnt & Technology*, 1994, No. 5, pp. 31-34.
Y. Igarashi, S. Okada, "Observation and Analysis of the Nucleus of Spheroidal Graphite in Magnesium-Treated Ductile Iron," *International Journal Cast Metal Research*, 11[2], 1988, pp. 83-88.

*Primary Examiner*—Sikyin Ip
(74) *Attorney, Agent, or Firm*—Boyle Fredrickson Newholm Stein & Gratz, S.C.

(57) ABSTRACT

An additive for increasing the toughness of thin-wall iron castings is provided. The additive includes amounts of a non-ferrous metal oxide and a metal sulfide in which the non-ferrous metal has an affinity for oxygen less than that of iron, and the metal has an affinity for sulfur less than that of magnesium. The metals contained in the oxides and sulfides are also not alkali, alkali earth or rare earth metals to reduce the incidence of defect formation in the castings. The metal oxide and metal sulfide, when added to a cast iron melt react with magnesium added to the melt as a spheroidizing graphite element to form nucleation sites having a core of magnesium oxide surrounded by magnesium sulfide. These nucleation sites allow for increased nucleation of graphite, whether in vermicular or spheroidal form, such that the cross-section of the thin-wall iron casting is more uniform, thereby decreasing the amount of carbide formed in the casting and increasing the toughness of the casting.

8 Claims, 2 Drawing Sheets

Fig. 1
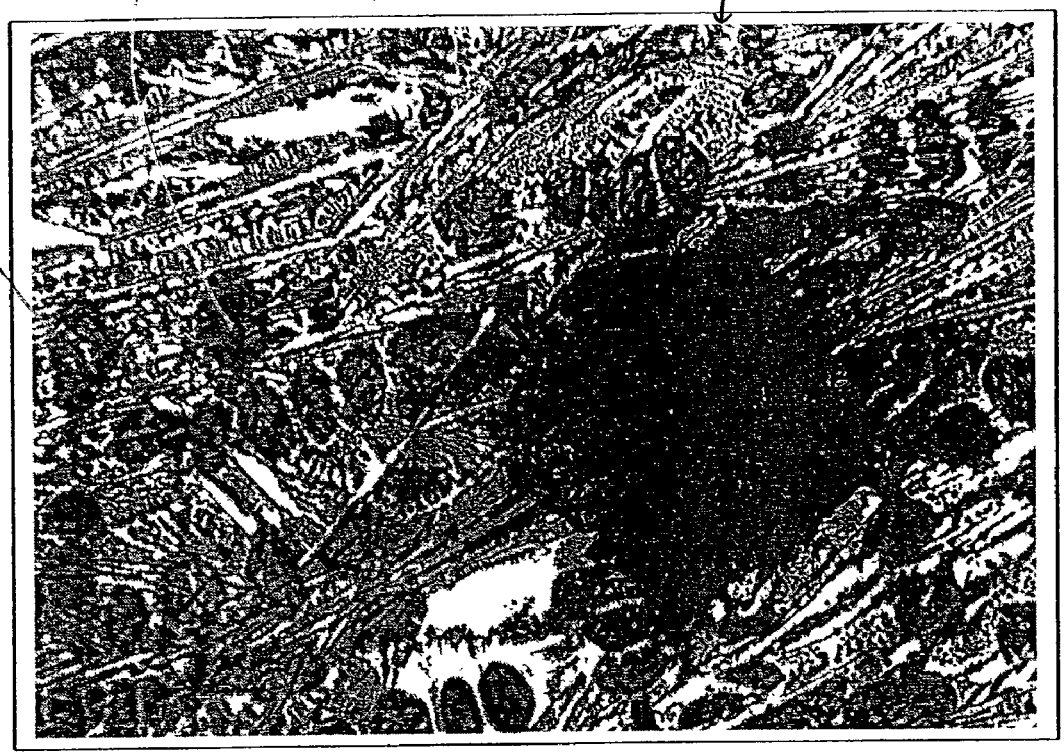
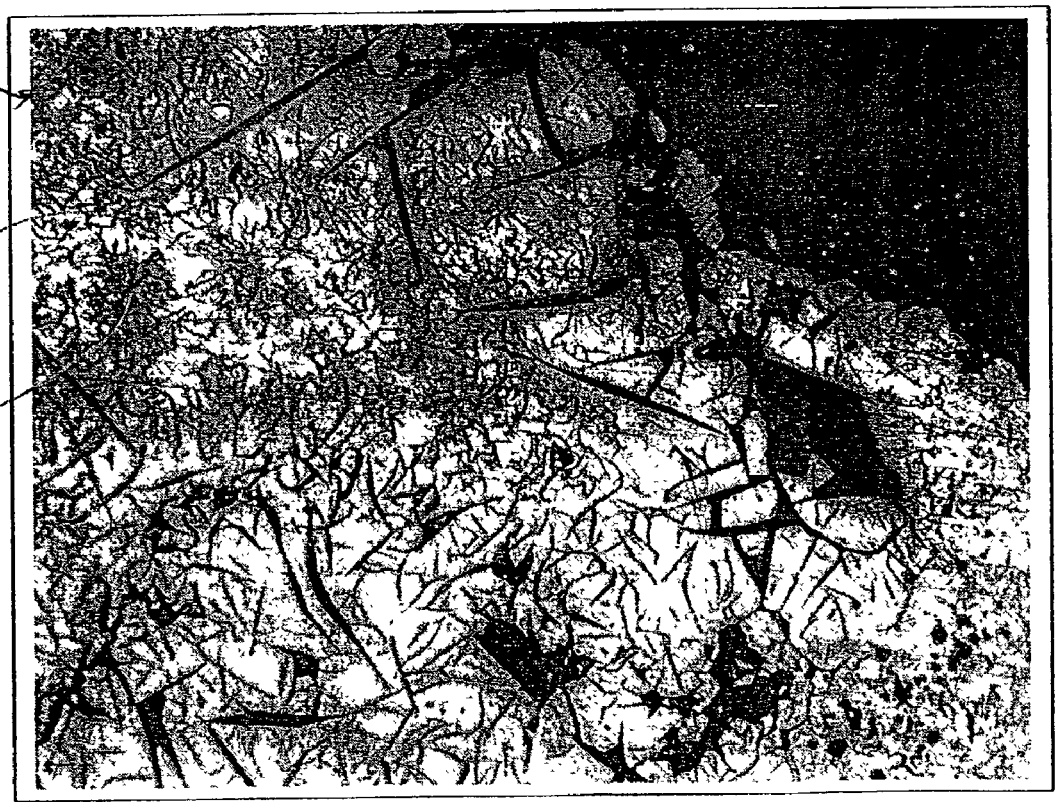
Fig 2

ADDITIVE FOR INOCULATION OF CAST IRON AND METHOD

FIELD OF THE INVENTION

The present invention relates to the formation of thin-wall cast iron components and more specifically to an inoculant additive and method of use for the additive with an inoculant to increase the toughness and machinability of the thin-wall cast iron so formed.

BACKGROUND OF THE INVENTION

The usual microstructure of compacted graphite iron (CGI) consists of a matrix of ferrite and/or pearlite, which are formed from austenite, with a vermicular type of graphite dispersed throughout. In ductile iron (DI), the usual microstructure has a similar metal matrix with graphite spheroids or nodules dispersed throughout the structure. Both CGI and DI exhibit excellent castability, allowing the production of thin-wall castings from these iron types. However, the rapid cooling during solidification of these thin-wall castings makes it difficult to achieve the required microstructure in the as-cast condition, and hard, brittle carbides are nearly always present. As a result, the mechanical properties (e.g., hardness, ductility, toughness, etc.) are detrimentally affected as is machinability, limiting the successful production of thin-wall castings from CGI and DI.

The amount, size and distribution of vermicular and nodular graphite particles in the structure of the CGI and DI, respectively, are very important to the physical properties of the irons. The use of inoculants to control microstructure as well as to reduce the "chill tendency" or the formation of iron carbides (or cementite) is common practice in the ferrous foundry industry. The presence of iron carbides in the CGI or DI microstructure is undesirable because this constituent of the microstucture is hard and brittle and can result in poor mechanical properties (e.g., hardness, ductility, toughness, etc.) and machinability of the CGI and DI. Therefore, foundry metallurgical practices include the step of inoculating the metal so that nucleation and growth of the vermicular graphite or nodules occurs in a pattern that enhances the desired properties of the CGI or DI. The inoculating agent can be added to the pouring ladle, can be injected or sprayed in a finely divided or powdered form into the metal pouring stream as the molten metal enters the mold, or can be formed as an insert that is placed in the mold prior to pouring the molten metal into the mold.

The necessity of inoculation for different types of cast iron is determined by the thermodynamic nature of the molten iron as determined by the iron-carbon equilibrium diagram, which exhibits both stable (iron-graphite) and meta stable (iron-cementite) liquid-solid type transformations. Only a small temperature gap separates stable from meta stable iron solidification. Also, different kinetic effects and thermodynamic deceleration of the iron solidification can undercool a melt and promote cementite formation, i.e., the chill tendency. From a practical point of view, the main factors which increase chill tendency of a melt are the following:

a) increasing the rate of cooling during solidification in thin-wall castings;
b) the transformation of graphite to flake graphite and to vermicular and/or nodule shape (spheroidal) graphite; and
c) the presence of cementite-forming elements.

All of these factors are present to some extent during thin-wall casting production using DI and CGI. The rapid cooling during solidification of thin-wall castings makes it very difficult to achieve the required structure in the as-cast condition and the mechanical properties and machinability of the casting are detrimentally affected, thereby limiting the successful production of thin-wall castings from DI and CGI.

While nucleation or growth of eutectic cells in gray iron occurs when both the austenite and the flake graphite are in contact with the melt, this is not typical in DI where early in the solidification process the graphite spheroid is surrounded by an austenite shell. Vermicular graphite in CGI also has limited contact with melt. Therefore, direct contact with melt is lost and the spheroidal or vermicular graphite eutectic cell growth rate in DI and CGI is dependent on graphite diffusion through the austenite shell. The presence of the shell slows graphite diffusion and decreases the eutectic cell growth rate, consequently increasing undercooling and carbide formation in DI and CGI. Therefore, homogeneous nucleation will not occur unless an effective substrate, such as an inoculant, is present that will provide additional nucleation sites in the melt.

Inoculants can best be described as elements that can form stable compounds with sulfur and/or oxygen. These oxy-sulfide atomic clusters provide a substrate surface upon which dissolved carbon in the molten iron can "nucleate" or start to grow as graphite flakes or nodules to enhance desirable physical properties for the iron castings formed, before sufficient undercooling occurs that favors the formation of carbides which increase the hardness of the iron.

Numerous metal compositions and alloys have been proposed for use as inoculating agents in the production of both CGI and DI thin-wall castings. Standard inoculating agents are calcium silicon, calcium bearing ferrosilicon alloys or other ferrosilicon based alloys that contain small percentages of oxy-sulfide forming elements, and finely divided and powdered synthetic graphite.

As discussed previously, inoculants are commonly added to the molten metal in the pouring ladle prior to the actual solidification process. A major problem in using any of the above inoculants as a ladle addition is that the effectiveness of the inoculant diminishes rather rapidly after it is added to the metal. Thus, the first castings poured usually have improved microstructures and graphite structures versus those poured with metal from the same ladle only a few minutes later. This process of diminished effectiveness of inoculants with time at elevated metal pouring temperatures is known as inoculant fade. To circumvent or limit inoculant fade, some of the same inoculating alloys are used in a powdery or granular form and injected into the metal stream just prior to entering the mold. These methods are usually more effective and normally much smaller amounts of inoculant need to be added. However, mechanical problems associated with the actual injection process as well as the precise timing necessary for the injection of the inoculant powder into the metal stream may be the source of inconsistent results and contamination from un-dissolved inoculant particles.

Inoculating in the mold is a third alternative, although it is not widely used. In this inoculation method, either small lumps of calcium bearing ferrosilicon can be used or alternately, cast inserts made with ferrosilicon may be used. Further, since inoculation is performed essentially at the very last moment before solidification and virtually no time is available for fade in this method, even smaller amounts of inoculant may be used than are used when injecting the inoculant into the poured metal stream. However, efforts to make tablets with inoculant containing materials employing different binders have not met with commercial success. More recently, compacted and sintered fines of magnesium ferrosilicon and other silicon containing alloys have been also produced in the shape of a tablet for use as an in the mold inoculant, but still exhibit certain deficiencies.

In the manufacture of thin-wall CGI and DI castings, it is virtually essential to make an addition of an either a calcium bearing ferrosilicon or one of the more potent ferrosilicon inoculants containing relatively small percentages of oxy-sulfide forming elements prior to pouring the casting. In the case of the latter inoculant, these oxy-sulfide forming elements combine with dissolved oxygen and sulfur in the liquid iron. In almost all cases, the purpose of the ferrosilicon is to act only as a carrier for the oxy-sulfide forming elements and the ferrosilicon by itself provides little to no inoculating effect. Only certain amounts of these inoculating capable elements (or oxy-sulfide forming elements) can be technically and feasibly smelted and alloyed with the ferrosilicon to produce commercially and economically available alloy products. This is largely due to the limited solubilities of the oxy-sulfide forming elements in liquid ferrosilicon alloys. It should be mentioned that ferrosilicon is used as the carrier medium because ferrosilicon is relatively inexpensive and dissolves quite easily when added to cast irons, thereby liberating through dissolution in the molten iron the small amounts of elements that can react with dissolved oxygen and sulfur present in the melt.

One inoculant of this type is known by the tradename of Superseed or Stronsil. This inoculant is a strontium bearing ferrosilicon alloy containing small amounts of strontium (less than 1%) to promote the formation of graphite flakes and to minimize the formation of iron carbides. Other such ferrosilicon inoculants that contain strontium, calcium and either zirconium or titanium are disclosed in U.S. Pat. No. 4,666,516. Another titanium ferrosilicon alloy, this one containing magnesium is disclosed in U.S. Pat. No. 4,568,388. Finally, inoculating alloys for CGI are also known which include barium, e.g., U.S. Pat. Nos. 3,137,570 and 5,008,074.

The presence of alkali and/or rare earth metals in ferrosilicon inoculant compositions create extra nucleation sites for graphite by reacting with the soluble in-melt impurities of sulfur and oxygen. For example, inoculants combining ferrosilicon with barium, strontium, and/or calcium are effective for forming iron castings having flake graphite, as barium increases the time at which inoculant fade occurs, and strontium promotes graphite formation while minimizing iron carbide formation. However, for spherical and vermicular graphite formation in castings from DI and CGI, these cast irons are highly refined to remove practically all of the impurities present, i.e., sulfur and oxygen, by using a magnesium treatment. Thus, the alkali and rare earth metals in the conventional inoculants do not have the necessary oxygen and sulfur to react with and therefore cannot create additional nucleation sites. As a result, these types of inoculants are not very effective for thin-wall DI and CGI castings. Also, attempts to create extra nucleation sites in CGI and DI by putting into the melt preformed non-metallic substrates have not been effective and do not produce stable and uniform thin wall CGI or DI structures.

The reason for this is that most traditional inoculants do not contain intentional additions of sulfur or oxygen and must rely on the potential reaction of the oxy-sulfide forming elements which are added to traditional inoculants. Traditionally, all ferrosilicon based inoculants are smelted and refined in submerged arc furnaces and it is technically unfeasible to smelt sulfur and oxygen in combination with these alloys because of liquid solubility constraints. It is also difficult, if not impossible to incorporate significant amounts of these property enhancing elements, i.e., sulfur and oxygen, in traditional smelted ferroalloys.

The effectiveness of all inoculating agents is a direct function of the amount of sulfur dissolved in the molten irons and to a lesser extent, the amount of dissolved oxygen present. The ability of oxy-sulfide forming elements to form nuclei assisting substrates, i.e., oxy-sulfide atomic clusters, which in turn provide a similar crystalline surface onto which dissolved carbon atoms can precipitate from the liquid iron and grow is a necessary prerequisite for inoculation. Therefore, the ability to incorporate sulfur and oxygen containing elements in the inoculant used in the formation of thin-wall CGI and DI castings would insure that sufficient sulfur and oxygen are available for subsequent reaction with the oxy-sulfide elements added with or contained in inoculants. Addition of these sulfide and oxygen compounds would rejuvenate the molten iron and improve its responsiveness to inoculation.

To this end, inoculating additives containing oxygen and sulfur components that increase the effectiveness of inoculants used for thin wall castings have been developed, the most recent of which are disclosed in Skaland U.S. Pat. No. 6,102,983, Igarashi et al. U.S. Pat. No. 6,126,713 and Naro U.S. Pat. No. 6,293,988. Each of these patents discloses an inoculation additive for improving the effects of the inoculation of thin-wall cast iron that is formed of a powder including oxide and/or sulfides and other alkali metals for promoting the nucleation of graphite in the molten iron.

More specifically, Naro U.S. Pat. No. 6,293,988 discloses that to improve the effectiveness of inoculation, a ferrosilicon free inoculant is utilized. This inoculant is mechanically pressed into a tablet from a powdered mixture which is formed of 10 to 49% wt. % silicon, 7 to 20% wt. % calcium, 2.5 to 10% wt. % sulfur, 2 to 4% wt. % of oxygen, and 2.5 to 7.5% wt. % magnesium with the balance being iron, and is used as an in-mold inoculant.

Further, Igarashi et al. U.S. Pat. No. 6,123,713 discloses an additive for use in producing DI castings which contains: (a) fine particles of magnesium oxide, and (b) a graphite spheroidizing material or inoculant, with a weight ratio of component (a) to component (b) in the additive of between 0.0001:1 to 0.6:1.

Also, according to Skaland U.S. Pat. No. 6,102,983 an inoculant for the manufacture of iron with flake, compacted, or spherical graphite is disclosed that has a base formed of a ferrosilicon alloy and includes 0.5–10% wt. % calcium, and/or strontium, barium, cerium, or lanthanum, a first additive having 0.5–10% wt. % oxygen in the form of one or more metal oxides, and/or a second additive having 0.1–10% wt. % of metal sulfide, followed by agglomeration of the components with a binder to form the inoculant.

In each of the above-disclosed inoculant additives or modifiers, the included oxides and sulfides of alkali or rare earth metals can create extra substrates or sites for graphite nucleation during the iron solidification. However, the large amount of liquid-solid interface energy in DI or CGI that has been refined by the addition of magnesium makes it difficult to effectively distribute the oxides and sulfides of alkali and/or rare earth metals throughout the cast iron melt. More specifically, the oxides such as MgO, $SiO_2$, CaO, $TiO_2$, among others, which are disclosed in these patents, often do not melt or dissolve and have a tendency to agglomerate in the melt, even if they are used in the form of a fine powder. As a result, the effectiveness of inoculants formed with these types of oxide and/or sulfide components decreases, which makes it difficult to produce thin-wall castings of GCI or DI with the desired and substantially uniform structure. Further, in each of the above-disclosed inoculants, the inoculant does not contain a sulfur providing component necessary to promote nucleation, the inoculant contains significant amounts of calcium causing slag defect formation to readily take place in the castings or the inoculant includes an additional binder which also causes defects to form in the casting.

As a result, it would be desirable to develop an additive for an inoculant used in the production of thin-wall CGI and DI castings that has a simple and easy to formulate composition, and that also includes both oxygen and sulfur containing components to readily increase the available nucleation sites in the melt to form thin-wall CGI and DI castings having a substantially uniform structure with desirable mechanical properties. The additive should also be formed to have a composition that virtually eliminates the presence of any alkali or rare earth metal oxides or sulfides, or binders to avoid the defect formation problems associated with prior art inoculants and additives.

SUMMARY OF THE INVENTION

It is an object of the present invention to provide an additive for an inoculant used in the production of thin-wall CGI and DI castings which includes various oxides and sulfides that interact with magnesium present in the melt to form an increased number of nucleation sites in order to produce thin wall as-cast structures having desirable mechanical properties.

It is another object of the present invention to provide an additive for an inoculant including an oxide of a non-ferrous and non-alkali, alkali earth or rare earth metal with an affinity for oxygen smaller than that of iron, and a sulfide of a non-alkali, alkali earth or rare earth metal with an affinity for sulfur smaller than magnesium.

It is a further object of the present invention to provide an additive for an inoculant that is formed separately from the inoculant and that does not require smelting and/or alloying, or any binder to hold the additive and inoculant together.

It is still another object of the present invention to provide a method for introducing the additive into the molten iron either together with or separately from the inoculant in order to most effectively increase the number of nucleation sites immediately prior to the solidification of the cast iron melt to form thin-wall castings with a uniform structure having the desired mechanical properties.

The present invention is an additive for an inoculant used to promote graphite nucleation in molten iron that contains various oxides and sulfides that react with components in the melt to further increase the number of available nucleation sites in the melt formed as a result of the dissolution of the inoculant added to the melt. The inoculant is a conventional ferrosilicon inoculant that is well known in the art for its ability to form nucleation sites within a cast iron melt. Shells with a high silicon concentration develop around the ferrosilicon base of the dissolving inoculant, which create a favorable condition for the heterogeneous formation of carbon containing particles (flakes, spheroids, etc.) within the melt. These primary particles or nucleation sites are very active in promoting eutectic solidification around the sites because they have a crystallographic structure similar to the graphite present in the melt. The unique mixture of the oxides and sulfides present in the additive enhances the number of these sites by reacting with the magnesium (Mg) that is present in the melt as a result of its addition to the melt in order to refine impurities from the cast iron melt. The increased number of dispersed substrates or nucleation sites consequently prevents or at least significantly reduces the formation of iron carbide or cementite between the nucleation sites, such that the resulting thin-wall casting has greatly increased toughness, ductility and machinability.

More specifically, this invention relates to an additive formed of a composition of material which is capable of graphitizing cast iron in a highly effective and efficient manner. The additive composition is formed by combining and blending sulfur and oxygen compounds with other specific elements that are potent oxy-sulfide formers and are not alkali or rare earth metals. The elements used have an affinity for oxygen less than the affinity of iron for oxygen and that have an affinity for sulfur less than the affinity of magnesium for sulfur. These blended compounds are used to fabricate a granular or powdered mixture of essentially the same composition which can be used as a direct addition additive to the molten metal. The present invention also contemplates various methods of utilizing the additive in conjunction with a conventional ferrosilicon inoculant in order to increase the number of nucleation sites for graphite during ferrosilicon dissolution.

Numerous other objects, features and advantages of the present invention will be made apparent to one of ordinary skill in the art from the following detailed description taken together with the drawings.

BRIEF DESCRIPTION OF THE DRAWINGS

The drawings illustrate the best mode currently contemplated of practicing the present invention.

In the drawings:

FIG. 1 is an optical microphotograph (magnification: times 200) showing solidification of cast iron without utilizing the additive of the present invention;

FIG. 2 is an optical microphotograph (magnification: times 200) showing solidification of spheroidal graphite cast iron with utilizing the additive of the present invention.

DETAILED DESCRIPTION OF THE INVENTION

Figure 3:
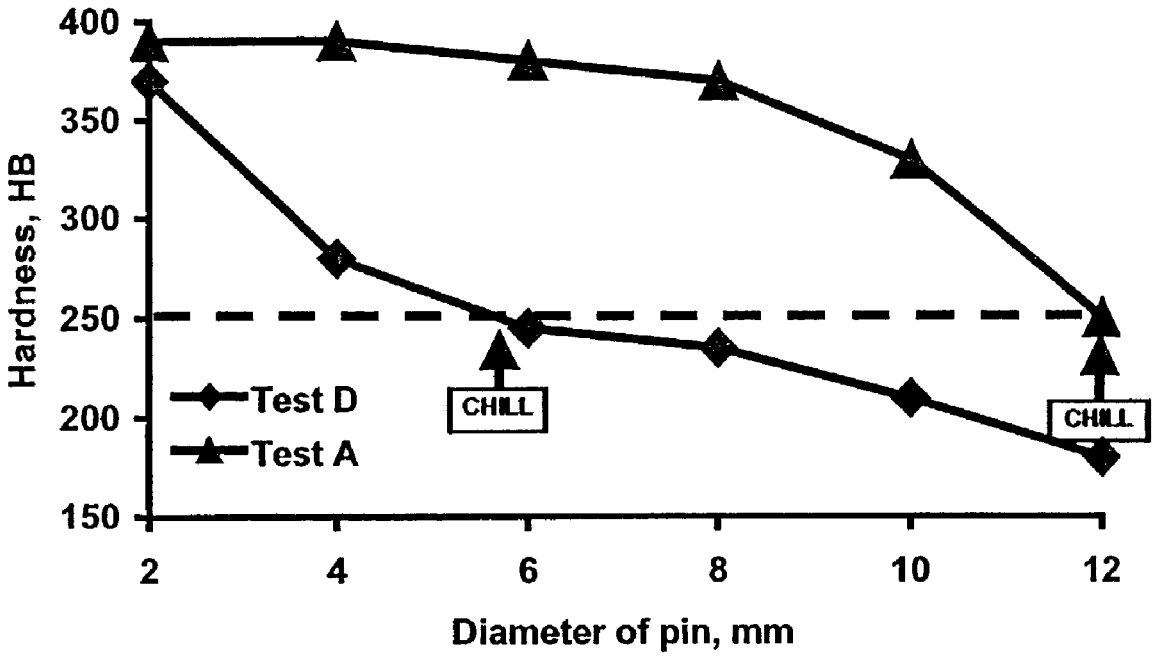
FIG. 3 is a graph illustrating the differences in the values for chill tendency and hardness between ductile cast iron pins treated with the additive of the present invention and untreated ductile cast iron pins.

In order to promote the formation of additional nucleation sites in molten iron, whether compacted graphite iron (CGI) or ductile cast iron (DI), to create a thin-wall casting having increased toughness and machinability and reduced hardness, the additive of the present invention is added to the molten iron. The additive of the present invention can be added to the CGI or DI melt in numerous fashions, such as with or in addition to a conventional inoculant, e.g., a ferrosilicon inoculant, that is also added to the melt.

The additive of the present invention, when added to molten DI and CGI, creates magnesium oxide and magnesium sulfide in the melt as a result of the reaction between certain components contained within the additive and the magnesium previously dissolved in melt to change shape of graphite. The magnesium oxides and magnesium sulfides are created by reactions that occur between the additive components and the magnesium found in areas of the melt that are supersaturated by the dissolution of the inoculant, e.g., ferrosilicon. The oxides and sulfides so formed provide nucleation sites for graphite in the melt in addition to the sites produced by the inoculant just before dissolution of the inoculant. The additive of the present invention therefore realizes the ability of the magnesium that is present in the melt for spheroidization of graphite in iron for in-situ formation of dispersed magnesium oxide and magnesium sulfide that form substrates or nucleation sites with a virgin surface. The magnesium oxide and sulfide can then be activated as nucleation sites during the consequent dissolution of the ferrosilicon inoculant in the melt.

Further, the composition of the additive allows for the use of a ferrosilicon inoculant with a low concentration of alkali earth and rare earth metals, i.e., less than 0.5% wt. % calcium and barium due to the ability of the reacting components of the additive to form nucleation sites with the magnesium already present in the melt. This consequently increases the rate of dissolution of the ferrosilicon inoculant in the melt and decreases the tendency for the formation of slag defects in the solidified cast iron that is associated with prior art additives that contain alkali and rare earth metal components.

As shown in FIGS. 1–2, the use of the additive results in the formation of a large amount of graphite nuclei within the supersaturated areas around dissolution of ferrosilicon inoculant particles in the melt that can be seen in the microstructures of the resulting thin-wall castings. The cooling of the melt was interrupted by quenching. More specifically, FIG. 1 illustrates a cross-section of the microstructure of iron solidified without utilizing the additive of the present invention. As shown in FIG. 1, the iron is formed with only a small number of graphite particles and the structure in thin-wall castings has iron carbide. The presence of this large amount of iron carbide increases the hardness and/or brittleness of the iron casting formed, making the casting unsuitable for many uses.

Alternatively, when the additive of the present invention is utilized to form DI, as shown in FIG. 2, the cross-sections of the microstructure of quenched iron includes a much greater number of graphite particles, such that the amount of carbide formed between the graphite particles is greatly reduced. Thus, the thin-wall iron castings formed utilizing the additive of the present invention have a much lower hardness or brittleness and much greater toughness, ductility and machinability, such that iron castings can be formed utilizing the additive into very thin castings with increased utility.

The additive of the present invention includes two essential components, namely: (a) an oxide of a non-ferrous metal, that is also not an alkali, alkali earth or rare earth metal, with an affinity for the oxygen present in the cast iron melt smaller than the affinity for oxygen of iron and (b) a sulfide of a metal, that is also not an alkali, alkali earth or rare earth metal, with an affinity for the sulfur in the cast iron melt smaller than the affinity for sulfur or magnesium. The determination of the specific metals that are found in the oxides and sulfides contained in the additive and having the necessary affinities for oxygen and sulfur was accomplished using thermodynamic calculations for the reactions occurring in the cast iron melt that take into account the activity of the concentration of the magnesium present in the melt (i.e., 0.01–0.05% wt. % of the melt), and the free energy of the oxides and sulfides incorporating the metals to be tested. Alkali, alkali earth and rare earth metals were not considered due to the impossibility of reducing these oxides and sulfides by magnesium in melt, to the formation of slag defects and other problems associated with these types of metals.

Based upon these calculations, it was determined that it is possible to form magnesium oxide in the iron melt by providing copper, nickel, cobalt and/or molybdenum oxides in the additive. Thus, the oxide component of the additive has the formula $R_mO_n$, where R is copper, nickel, cobalt or molybdenum, each of which have affinity for oxygen present in melt that is less than that of iron, which usually is present in a melt undergoing an open ladle treatment. As shown in the experimental results which follow measuring the oxygen activity in the melt, each of these oxides can be quickly reduced by the dissolved in-melt magnesium $[Mg]_{iron}$ to form magnesium oxide in the following manner:

$$R_mO_n+n[Mg]_{iron}=nMgO+m[R]_{iron} \quad \text{(equation 1)}$$

In addition, the thermodynamic calculations performed also determined that the sulfide contained in the additive comprise a sulfide formed with a metal selected from the group including iron, copper, cobalt, tungsten, vanadium, manganese, chromium, molybdenum, nickel and combinations thereof. Each of these metals is not an alkali or rare earth metal to avoid defect formation and because sulfides of an alkali or rare earth metal can not be reduced by magnesium in melt. On the contrary, the sulfide contained in the additive comprise a sulfide formed with a metal selected from the group including iron, copper, cobalt, tungsten, vanadium, manganese, chromium, molybdenum, nickel and combinations thereof can react with the magnesium present in the melt to form magnesium sulfide. The magnesium sulfide that is formed by the reaction of the magnesium in the melt with the additive due to the presence of the sulfide in the additive is formed pursuant to the following reaction:

$$R_mS_n+n[Mg]_{iron}=nMgS+m[R]_{iron} \quad \text{(equation 2)}$$

As stated previously, the reason for the occurrence of this reaction in the melt is that the sulfide ($R_mS_n$) in the additive is formed with a non-alkali, alkali earth or rare earth metal having an affinity for sulfur less than that of magnesium.

From the known value for the free energy of formation of the oxides and sulfides in the iron melt, it has also been determined that the magnesium oxide forms first in the melt and functions as a substrate for magnesium sulfide formation around the magnesium oxide, which is necessarily less strongly activated in the supersaturated zones of the ferrosilicon inoculant dissolution. This has been confirmed by electron microscopic studies of the interior of complex graphite nodule substrates that show magnesium oxide forming the center of the module that is surrounded by magnesium sulfide on which the graphite has nucleated. Therefore, to ensure that enough of the magnesium oxides are formed in the melt to effectively accomplish the formation of the increased number of in-melt nucleation sites, the preferred composition of the additive has a weight ratio of oxides to sulfides that is between approximately 0.25:1 and approximately 2.00:1. Even better results are obtained when a more preferred composition of the additive is used in which the weight ratio of the oxides to the sulfides in the additive is between approximately 0.5:1 and approximately 1.5:1 and most preferably when the ratio is approximately 1:1. Further, while it is most preferable to form the additive with only the oxides and sulfides, other components such as nitride can also be combined in the additive to further enhance the utility of the additive.

In order to effectively utilize the additive of the present invention in forming thin-wall castings, the method of adding the additive to the cast iron forming process must also be carefully controlled. For example, in a preferred method the additive is added to the melt in amounts of between 0.0001% wt. % and 0.10% wt. % of the melt, and most preferably between 0.005 and 0.04% wt. %, after magnesium spheroidizing treatment and before adding the ferrosilicon inoculant to the melt. This allows the oxides and sulfides in the additive to react with the in-melt magnesium to form the complex nucleation substrates in the zones formed by the dissolving inoculant in the manner described above which results in an increased number of nucleation sites for the graphite layers. Also, in the preferred method for forming the nucleation sites, the additive preferably has an average particle size of between 0.0005 mm and 0.20 mm and more preferably between 0.001 mm and 0.10 mm and the inoculant preferably has an average particle size of preferably between 0.1 mm and 30 mm and more preferably between 0.2 mm and 20 mm. However, in addition to the above preferred method, the additive can alternatively be added to the melt either simultaneously with the inoculant or before introducing the inoculant to the melt in a conventional manner consistent with the condition of the melt (i.e., in the ladle, being poured from the ladle or in the mold), if desired.

EXPERIMENTAL

The effectiveness of the additive of the present invention in forming thin-wall castings was evaluated to ascertain the increase in desirable mechanical properties achieved through the use of the additive and to determine the most effective method of treating the liquid iron with the additive when forming the improved thin wall castings. These experiments evaluated the main structural parameters of thin-wall castings produced, including chill tendency, carbide formation, nodule count and uniformity of graphite content made from melts treated with the additive in various alternative methods of the casting process in comparison with the structural parameters in thin-wall castings made pursuant to conventional inoculant techniques without using the additive. Each of the experiments was conducted on magnesium treated ferrite-pearlite type DI. For each experiment, return scrap (70% wt. %), steel scrap (30% wt. %) and pure carbon raiser (1.5% wt. %) were melted at approximately 2750° F. using an induction furnace to prepare a melt having the chemical composition shown in Table 1.

TABLE 1

| | Chemical Compositions of Iron, % wt. % of the Melt | | | | | |
|---|---|---|---|---|---|---|
| | Carbon | Silicon | Manganese | Phosphorus | Sulfur | Magnesium |
| Melt | 3.7 | 1.7 | 0.2 | 0.01 | 0.007 | – |
| Castings | 3.6 | 2.8 | 0.2 | 0.01 | 0.008 | 0.04 |

For each casting, the magnesium treatment of the melt was performed on the melt in an open transfer ladle by a sandwich process as is known in the art using 1.7% wt. % of the melt of an iron based alloy, which contains 45% wt. % silicon and 6.2% wt. % magnesium. The treated melt was then inoculated during transfer to a pouring ladle by using 0.5% wt. % of the melt of a ferrosilicon inoculant having a composition of 75% wt. % silicon, 0.4% wt. % calcium, 0.4% wt. % aluminum, and an overall particle size of 3–15 mm. The inoculated melt was then poured into a chill wedge with a maximum thickness of 13 mm and a core mold with pins having diameters from 2 to 12 mm to form the thin-wall castings. Further, in those castings that were produced with the additive, the additive had a particle size of 325 U.S. mesh, or approximately less than 0.043 mm added to the melt. The additive was added to the melt at three different steps in the casting process for different castings to evaluate the effectiveness of the additive when added at each step, namely: (1) prior to inoculation but after magnesium treatment; (2) simultaneously with magnesium treatment; and (3)

after magnesium treatment and inoculation. Also, additives having each of the metal oxides and metal sulfides specified previously were evaluated at the same experimental conditions.

Once the castings were produced, the chill tendency and microstructure of the castings were evaluated using statistical computer aided metallography equipment, i.e., metallography microscope, Olympus America, Inc. and "Optimas®" software, Media Cybernetics, Inc.

EXAMPLE 1

In this example, the additive was added to each melt in amounts of 0.02% wt. % of the melt after magnesium treatment and before inoculation by ferrosilicon. The additive contained copper oxide and copper sulfide in a ratio of 1:1 in the casting formed in Test D. Also, these oxide and sulfide components were each used separately to form the additives in Test B and Test C, and were compared along with Test D to the casting formed without the additive in Test A. The results of these experiments are shown in Table 2. Also, the effect of the additive on the hardness and chill tendency of the addition casting formed in Test D is compared with the casting formed pursuant to the conventional inoculation technique in Test A are shown in FIG. 3 for ductile iron castings with varying pin diameters.

TABLE 2

| Test | Additive | Minimal thickness without cementite, mm | Nodule graphite number $mm^2$ in in casting with thickness: 3 mm | 5 mm |
|---|---|---|---|---|
| A | without | 5.0 | 450 | 400 |
| B | CuO | 4.0 | 550 | 480 |
| C | CuS | 3.5 | 570 | 520 |
| D | CuS + CuO | 2.5 | 700 | 600 |

As illustrated above, the results indicate significant improvement in the effectiveness of the inoculation, as well as decreasing chill tendency when the additive is used in any form having the oxide, the sulfide or the oxide and sulfide. Further, the best results were obtained when the additive included both the oxide and sulfide, which allowed the casting to be produced with a 2.5–3.0 mm wall thickness without cementite, and with uniform and higher nodule numbers than using conventional additives or inoculants.

EXAMPLE 2

In this example, results of which are given in Table 3, the effectiveness of the additive was evaluated when added to the melt at different steps during the method of liquid iron treatment. The following different methods of introducing the additive into the melt were tested:

1) addition of the additive after magnesium treatment and before inoculation by ferrosilicon (Test D);
2) addition of the additive simultaneously with magnesium treatment (Test E); and
3) addition of the additive after ferrosilicon treatment (Test F).

TABLE 3

| Test | Method | Minimal thickness without cementite, mm | Nodule graphite number $mm^2$ in casting with thickness: 3 mm | 5 mm |
|---|---|---|---|---|
| D | Addition after magnesium treatment and before inoculation | 2.5 | 700 | 600 |
| E | Addition simultaneously with magnesium treatment | 5.0 | 460 | 420 |
| F | Addition after magnesium treatment and inoculation | 3.7 | 520 | 480 |

As illustrated above, the best results were obtained when the melt was treated by the addition of the additive after magnesium treatment but before inoculation according to the method of Test D. Conversely, using the additive simultaneously with magnesium treatment of Test E or after ferrosilicon inoculation as in Test F are not as effective. This is because these methods do not allow the additive to greatly increase the nucleation by the in-situ formation of the nucleation substrates due to the lack of dissolving inoculant used to assist the formation of oxides and sulfides of magnesium in Test E and the lack of activation of these substrates by the graphite layers in Test F.

In short, the results of the above experiments show that the additive and method of liquid iron treatment using the additive are extremely effective for forming thin-wall CGI and DI castings in which the chill tendency for the castings is decreased, while the vermicular graphite or nodule count, the uniformity of the casting structure and the mechanical properties of the casting are each increased.

Various alternatives are contemplated as being within the scope of the following claims particularly pointing out and distinctly claiming the subject matter regarded as the invention.

We hereby claim:

1. An additive for use in forming a thin-walled iron casting, the additive comprising:

a) a metal oxide formed with a non-ferrous metal having an affinity for oxygen less than that of iron, the non-ferrous metal selected from the group consisting of copper, nickel, molybdenum and cobalt; and b) a metal sulfide formed with a metal having an affinity for sulfur less than that of magnesium, the metal selected from the group consisting of copper, nickel, iron, cobalt, tungsten, vanadium, manganese, chromium and molybdenum, wherein the metal oxide and metal sulfide do not include any alkali, alkali earth or rare earth metal components.

2. An additive for use with an inoculant in forming a thin-wall iron casting, the additive comprising:

a) a metal oxide formed with a non-ferrous metal having an affinity for oxygen less than that of iron; and b) a metal sulfide formed with a metal having an affinity for sulfur less than that of magnesium, wherein the metal oxide and the metal sulfide do not include any alkali, alkali earth or rare earth metal components, wherein the non-ferrous metal in the metal oxide is selected from the group consisting of: copper, nickel, molybdenum and cobalt.

3. The additive of claim 2 wherein the metal in the metal sulfide is selected from the group consisting of: copper, nickel, iron, cobalt, tungsten, vanadium, manganese, chromium and molybdenum.

4. The additive of claim 2 wherein the weight ratio of the metal oxide to the metal sulfide in the additive is between 0.25:1 and 2.00:1.

5. The additive of claim 4 wherein the weight ratio of the metal oxide to the metal sulfide in the additive is between 0.5:1 and 1.5:1.

6. The additive of claim 5 wherein the weight ratio of the metal oxide to the metal sulfide in the additive is approximately 1:1.

7. The additive of claim 2 wherein the additive has a particle size of between 0.0005 mm to 0.2 mm.

8. The additive of claim 7 wherein the additive has a particle size of between 0.001 mm to 0.1 mm.

* * * * *